US010906316B2

(12) United States Patent
Scott

(10) Patent No.: US 10,906,316 B2
(45) Date of Patent: Feb. 2, 2021

(54) METHOD FOR THE MANUFACTURE OF A MEMS DEVICE

(71) Applicant: XAAR TECHNOLOGY LIMITED, Cambridge (GB)

(72) Inventor: Bruce Scott, Cambridge (GB)

(73) Assignee: XAAR TECHNOLOGY LIMITED, Cambridge (GB)

( * ) Notice: Subject to any disclaimer, the term of this patent is extended or adjusted under 35 U.S.C. 154(b) by 0 days.

(21) Appl. No.: 16/645,336

(22) PCT Filed: Sep. 10, 2018

(86) PCT No.: PCT/GB2018/052566
§ 371 (c)(1),
(2) Date: Mar. 6, 2020

(87) PCT Pub. No.: WO2019/048888
PCT Pub. Date: Mar. 14, 2019

(65) Prior Publication Data

US 2020/0369030 A1 Nov. 26, 2020

(30) Foreign Application Priority Data

Sep. 8, 2017 (GB) ..... 1714507.9

(51) Int. Cl.
*B41J 2/16* (2006.01)
*B41J 2/14* (2006.01)

(52) U.S. Cl.
CPC ..... *B41J 2/1623* (2013.01); *B41J 2/14233* (2013.01); *B41J 2/161* (2013.01);
(Continued)

(58) Field of Classification Search
CPC ..... B41J 2/1623; B41J 2/1626; B41J 2/1628; B41J 2/1631; B41J 2/1645; B41J 2/161; B41J 2/14233
(Continued)

(56) References Cited

U.S. PATENT DOCUMENTS 9,401,471 B2 * 7/2016 Mizukami ..... H01L 41/29
9,662,880 B2 * 5/2017 Hays ..... B41J 2/1623
(Continued)

FOREIGN PATENT DOCUMENTS

JP 2001130009 A 5/2001
JP 2004074806 A 3/2004
(Continued)

OTHER PUBLICATIONS

Combined Search and Examination from the UK Intellectual Property Office for GB Application No. GB1714507.9, dated Mar. 9, 2018 (5 pages).
(Continued)

*Primary Examiner* — An H Do
(74) *Attorney, Agent, or Firm* — Finnegan, Henderson Farabow, Garrett & Dunner LLP

(57) ABSTRACT

A method for the manufacture of a microelectromechanical systems (MEMS) device comprising bonded components which together define a chamber in the device, which method comprises forming a bonding material layer on a surface of a first component, patterning the bonding material layer and, optionally, the first component and bonding a second component to the patterned bonding material layer and first component. The forming of the bonding material layer comprises partially curing a curable material and the bonding of the second component to the patterned bonding material layer and the first component comprises fully curing the partially cured material.

20 Claims, 6 Drawing Sheets

(52) U.S. Cl.
CPC ..... *B41J 2/1628* (2013.01); *B41J 2/1631* (2013.01); *B41J 2002/14241* (2013.01)

(58) Field of Classification Search
USPC ..... 347/68, 70–72
See application file for complete search history.

(56) References Cited

U.S. PATENT DOCUMENTS

| | | | | |
|---|---|---|---|---|
| 2017/0072691 | A1 | 3/2017 | Hays et al. | |
| 2019/0023014 | A1* | 1/2019 | Giusti | B41J 2/1623 |

FOREIGN PATENT DOCUMENTS

| | | | |
|---|---|---|---|
| WO | WO 2005/5122217 | A1 | 12/2005 |
| WO | WO 2009/142929 | A1 | 11/2009 |
| WO | WO 2017/082354 | A1 | 5/2017 |

OTHER PUBLICATIONS

International Search Report and Written Opinion for International Application No. PCT/GB2018/052566, dated Dec. 11, 2018 (13 pages).

* cited by examiner

METHOD FOR THE MANUFACTURE OF A MEMS DEVICE

This application is a National Stage Entry of International Application No. PCT/GB2018/052566, filed Sep. 10, 2018, which is based on and claims the benefit of foreign priority under 35 U.S.C. § 119 to GB Application No. 1714507.9, filed Sep. 8, 2017. The entire contents of the above-referenced applications are expressly incorporated herein by reference.

The present disclosure is generally concerned with a method for the manufacture of a microelectromechanical system (MEMS) actuated fluidic device comprising components which are bonded together to define a fluidic chamber and/or path within the device as well as with a MEMS device manufactured according to the method.

The present disclosure is particularly, although not exclusively, concerned with the manufacture of one or more droplet generating units for a droplet deposition head, such as an inkjet printhead, as well as with the manufacture of a droplet deposition head and a droplet deposition apparatus containing such droplet generating units.

Generally speaking, an inkjet printhead for an inkjet printer comprises a plurality of droplet generating units arranged adjacent to each other in an array provided within a substrate. Each droplet generating unit in the array comprises a fluidic path including a fluidic chamber, a nozzle and an actuator which is arranged to control ejection of droplets of a fluid from the chamber through the nozzle onto a print medium.

Typically, the nozzle for each droplet generating unit in the array is provided in a nozzle plate which is bonded to the substrate with an epoxy-based adhesive.

Such printheads can be manufactured by the application of manufacturing processes for MEMS devices and this has generally led to a reduction in the size of the components and attendant manufacturing cost. It has also led to increased print quality by, for example, allowing a higher density of droplet generating units to be used in the array as compared to those of inkjet printheads manufactured by other processes.

A typical manufacturing process for an inkjet printhead may, therefore, comprise progressive patterning of device layers provided within a substrate (for example, a silicon wafer) followed by bonding of a nozzle plate to the substrate and dividing (or dicing) into multiple arrays of droplet generating units. The bonding process, however, typically comprises an adhesive transfer process, for example, a blade coating technique using an epoxy-based adhesive.

In such a process, the epoxy-based adhesive is deposited as a layer onto an intermediate substrate by, for example, blade coating, spin coating or flexographic printing and the patterned substrate is contacted with the adhesive layer so that it contacts the adhesive layer and when the patterned substrate is removed, the adhesive is partially transferred to the surfaces of the patterned substrate which are to be bonded. The patterned substrate with the adhesive is subsequently contacted with the nozzle plate and the contacting surfaces bonded by, for example, the application of heat curing the adhesive under pressure.

Note that the bonding process may also be used to provide a cap layer for the one or more droplet generating units. The cap layer, which is protective of the device layers on the substrate, may be provided on one or more surfaces of the patterned substrate which are opposite to those provided with the nozzle plate.

One problem with this bonding process arises from local pressure differences due to the varying surface areas to be bonded. Even when the applied pressure is carefully controlled, different local bond thicknesses are found and a generally uniform thickness of adhesive layer is difficult to obtain. Further, especially when a fluidic chamber is to be formed, an applied pressure sufficient to ensure an adequate (for example, water tight) bond across the whole of the contacting surfaces generally results in local deformation of the adhesive layer and in turn a specific thickness between the contacting surfaces as well as protrusions of adhesive beyond the contacting surfaces.

These adhesive protrusions or "adhesive fillets", may extend along the edges of the bonded surfaces of the fluidic chamber and can cause partial or complete blocking of the fluid path by overlap during bonding and/or subsequent loosening of a fillet, or part of a fillet, from the surfaces.

One approach to this problem requires that the surfaces to be bonded together are of a similar shape and size so as to ensure uniform application of bonding pressure. Another approach requires that the contacting surfaces include features such as trenches or cavities that can accommodate adhesive deformation so as to minimise protrusion beyond the contacting surfaces.

The present disclosure provides a method which substantially avoids this problem because it does not rely upon an adhesive transfer bonding process.

The method is based upon the use of bonding material, other than a conventional epoxy-based adhesive, which can be patterned by conventional means yet retaining an ability to bond following the patterning without significant deformation under the applied pressures typical to bonding conventional epoxy-based adhesives.

In a first aspect the present disclosure provides a method for the manufacture of a microelectromechanical systems (MEMS) actuated fluidic device comprising bonded components which together define a fluidic chamber and/or a fluidic path in the device, which method comprises forming a bonding material layer on a surface of a first component, patterning the bonding material layer and, optionally, the first component and bonding a second component to the patterned bonding material layer and the first component, wherein the forming of the bonding material layer comprises partially curing a curable material on the surface of the first component by heating to a first temperature in an inert atmosphere, and the bonding of the second component to the patterned bonding material layer and the first component comprises fully curing the partially cured material by heating the components to a second temperature different to and above the first temperature.

Note that a reference to a component is a reference to a discrete structural part of a MEMS device. It may or may not comprise a silicon or other substrate within which device layers are provided (known as a "wafer") as long as at least one component is such a substrate. It is not limited by shape, feature or material and may, for example, comprise a stainless steel or glass plate or the like.

Note further that a reference to a fluidic chamber or path is a reference to a portion within at least one substrate which is void when the components are bonded together. The fluidic path may, in particular, include a fluidic chamber (or pressure chamber) providing for a fluid to be used with the device.

In one implementation, the method comprises patterning the bonding material layer and the first component. In another implementation, in which the second component includes a pre-formed cavity, the method comprises patterning only the bonding material layer.

The patterning may comprise forming a mask layer providing a mask on the bonding material layer, removing a portion of the bonding material layer and, optionally, first component through the mask and removing the mask layer. The patterning of the bonding material layer and, optionally, the first component through the mask provides that the edges of the bonding material layer are substantially coincident with those of the bonding surfaces of the first component.

In one implementation, the patterning of the first component may be carried out as an anisotropic etch so that the resultant fluidic chamber and/or path walls are tapered, or have trapezoidal cross-section or a surface that is not perpendicular to the bonding surfaces of the patterned first component.

The partially cured material may be obtained by heating or photoirradiation of a precursor layer deposited by conventional means to an extent that it maintains a shape on the first component supporting the mask layer and patterning by conventional means whilst retaining an ability to strongly bond to the second component. Preferably, the extent of partial curing is between 50 and 90%, preferably 70 to 90%, 75 to 85%, around 80%.

Note that the epoxy-based adhesives conventional to adhesive transfer bonding cannot be partially cured and do not support a mask layer unless they are cured. Although they can be patterned when fully cured they are consequently not adhesive and cannot be used for subsequent bonding.

In these implementations, the bonding of the second component to the patterned bonding material layer may comprise curing the partially cured material layer to completion (95% to 100%) by heating under pressure. Complete curing may be achieved while simultaneously applying pressure and heat. In other embodiments, the bond is formed while applying pressure over a reduced temperature and the bonding material is then subsequently cured to completion using an oven or hot plate set at a raised temperature to complete the curing.

In one implementation, the bonding material layer is based on a polymerisable alkene exhibiting some ring strain, such as a cyclobutene. The cyclic alkene may, in particular, comprise a benzo-cyclobutene or bisbenzocyclobutene such as those which are available under the trade mark Cyclotene (3000 or 4000 series; from Dow Chemical Company).

In another implementation, the bonding material layer is based on a polymerisable epoxide which is partially curable. Suitable partially curable epoxides include novolac epoxides such as those known as SU8 negative photoresists.

In still another implementation, the bonding material layer comprises a partially cured polyimide, for example, a partially cured aliphatic or aromatic polyimide. Suitable polyimides include those which are available under the trade mark HD Microsystems (for example, PI-5878G).

The forming of the mask layer providing a mask on the bonding material layer may comprise forming a layer of a photoresist on the bonding material layer and patterning the photoresist by photo-irradiation and development of a portion of the mask layer.

The photoresist may be either a negative or a positive photoresist provided that the conditions used for its photo-irradiation and development are compatible with retention of the bonding material layer.

Preferably, the photoresist is a positive photoresist. Suitable photoresist materials and conditions for photo-irradiation, development and removal of the mask layer are, however, conventional and include those based on and suitable for poly(methyl methacrylate), poly(methyl glutarimide), diazonaphthoquinone/phenol, SU8 and OSTE polymers.

The removal of the portion of bonding material layer and portion of the first component through the mask may be performed in a single step or in two or more separate steps.

In one implementation, the removal of both these portions is performed by etching, for example, by dry etching and, in particular, reactive ion etching (RIE). In another implementation, the removal of the portion of bonding material layer is performed by reactive ion etching (RIE) and the removal of the portion of the first component is performed by deep reactive ion etching (DRIE).

Suitable etchants for the bonding material layer and/or the first component will be known to those skilled in the art. Methods and materials for etching the above-mentioned Cyclotenes, for example, are available from Dow Chemical Company literature.

The reactive ion etching may, in particular, use an $O_2$:$CH_4$ plasma (for example, 4:1) and the deep reactive ion etching a $SF_6$ plasma (with $C_4F_8$ passivation). Alternatively, however, the reactive ion etching may use $O_2$:$SF_6$ plasma (for example 5:1) and the deep reactive ion etching a $SF_6$ plasma (with $C_4F_8$ passivation).

Suitable methods for depositing the precursor layer and the masking layer on the surface of the first component include dip coating, spin coating, spray coating, flexographic printing, painting etc. Preferably, the materials for the mask layer and the precursor layer are amenable to spin coating. Spin coating the precursor layer, for example, enables a very precise control of the thickness of the bonding material layer on the surface of the first component and in the device.

The partially cured bonding material layer may, in particular, have a thickness of between 0.5 μm and 2.2 μm and the mask layer of a thickness of 5 to 10 μm. Suitable spin coating and partial curing protocols are easily determined or calculated from the available literature.

In one implementation, therefore, the forming of the bonding material layer on the first component comprises partially curing a Cyclotene (for example, 3022-35) by heating at a temperature below or equal to 210.0 for 20 to 50 minutes (preferably, in an inert atmosphere with less than 100 ppm $O_2$).

The bonding of the second component to the patterned bonding material layer may, in particular, comprise heating the components at a temperature between 150.0 and 300.0 for up to 2 hours.

The heating may, at least in part, be accompanied by the application of a bonding force to the components of between 5 and 20 kN (for example, 10 kN or 15 kN, applied over a total of a standard 6" wafer area of which the bond area is about 81% of the total wafer area).

It will be understood that the force applied to the components translates into pressure with respect to the contact area between the bonding surfaces, such that any cavities in one component that define e.g. the pressure chambers will reduce the total contact area with e.g. the nozzle plate component, and consequently will increase the pressure applied. As an example, the contact area between a nozzle plate component and a pressure chamber component may be around 80% of the entire wafer area when unpatterned.

In the case of Cyclotene (for example, Cyclotene 3022-35), the bonding of the second component to the patterned bonding material layer may, in particular, comprise heating the components at 130.0 for 5 minutes under a bonding force of 12 kN followed by heating without pressure being applied at 250.0 for 1 hour.

Preferably, the selection of the heating protocols and the bonding pressures for a particular bonding material layer are such that the fully cured bonding material has a relatively uniform thickness across the contacting surfaces in the device and the extent of flow into the chamber during the bonding does not exceed 1.5 μm and, in particular, 1.0 μm. The fully cured bonding material layer may, in particular, have a thickness of between 0.5 μm and 2.2 μm, for example, about 1.1 μm.

The method may provide for the manufacture of one or more droplet generating units for a droplet deposition head, such as an inkjet printhead.

In one implementation, the first component may comprise a thin film actuator element arranged on a membrane so as to deform the membrane on receipt of an electronic signal, the second component may comprise a nozzle plate and the first and second components together define a fluidic chamber and path for a fluid. The thin film actuator element may, in particular, comprise a piezoelectric thin film element.

In another implementation, the first component may comprise a thin film actuator element arranged on a membrane so as to deform the membrane on receipt of an electronic signal, the second component may comprise a cap layer having a pre-formed cavity therein and the first and second component together define a fluidic path for a fluid. The thin film actuator element may, in particular comprise a piezoelectric thin film element.

Of course, the method may additionally comprise forming a bonding material layer on another surface of the first component (or second component), patterning the bonding material layer and, optionally, the first component (or second) and bonding a third component to the bonding material layer and the first component (or second component).

Alternatively, the method may additionally comprise forming a bonding material layer on a surface of a third component, patterning the bonding material layer and, optionally, the third component, and bonding the first component to the bonding material layer and the third component.

Note that the method is not limited by the order in which the second and third components are bonded. Note further that the forming of the bonding material layer, the patterning and/or the bonding may be carried out in the same way as described for the first and second components. The partial curing may use the first temperature and the full curing may use the second temperature (viz. a second temperature which is different to and above a first temperature). Note that these temperatures may be the same or different as those used for the first and second components. However, the forming of the bonding material layer may alternatively comprise depositing a curable material on a component using a mask so that patterning the bonding material layer is not necessary.

In one implementation, the first component may comprise a thin film actuator element as described above, the second component may comprise a nozzle plate as described above and the third component may comprise a cap layer as described above. In that case, the cap layer may be bonded to a surface of the actuator component opposite to that on which a nozzle plate is or is to be bonded.

In a second aspect, the present disclosure provides a MEMS device comprising a first component and a second component which together define a fluidic chamber and/or path for the device, wherein the first and second components are bonded by a patterned bonding material layer comprising a bonding material which is patternable when it is partially cured.

The bonding material may, in particular, be patternable by conventional patterning methods including, for example, chemical lithography and photolithography.

In a third aspect, the present disclosure provides a MEMS device comprising a first component and a second component which together define a fluidic chamber and/or path for the device, wherein the first and second components are bonded by a bonding material layer therebetween and wherein the fluidic chamber and/or path is substantially free from a bonding material fillet.

Note that a reference to a fluidic chamber and/or path which is substantially free from a bonding material fillet includes a reference to a fluidic chamber and/or path in which the protrusion of the bonding material layer beyond the first and second components into the fluidic chamber and/or path is 1.5 μm or less and, in particular, 1.0 μm or less.

Implementations of the second and third aspects of the present disclosure will be apparent from the foregoing description relating to the first aspect.

The MEMS device may, for example, comprise one or more droplet generating units for a droplet deposition head, such as an inkjet printhead. As mentioned above, the first component may comprise an actuator element arranged on a membrane so as to deform the membrane on receipt of an electronic signal, the second component may comprise a nozzle plate and the first and second components together define a fluidic chamber and/or path for a fluid such that the volume of the fluidic chamber varies by deformation of the membrane by the actuator element.

In a fourth aspect, the present disclosure provides for use in the manufacture of a MEMS device (for example, a droplet generating unit) of a partially curable bonding material which is patternable when partially cured for bonding components of the device which together define a fluidic chamber and/or path within the device.

In a fifth aspect, the present disclosure provides a method for fabricating one or more droplet generating units in the manufacture of a droplet deposition head, such as an inkjet printhead.

In a sixth aspect, the present disclosure provides an inkjet printhead comprising one or more MEMS devices of the second or third aspect.

In a seventh aspect, the present disclosure provides an inkjet printer comprising the inkjet printhead of the sixth aspect.

Implementations of the fourth to seventh aspects of the present disclosure will also be apparent from the foregoing description relating to the first aspect.

Note that the method of the first aspect may comprise bonding a nozzle plate to a first component comprising a plurality of actuator elements and/or bonding a cap layer to the first component comprising a plurality of cavities as described above and that the fifth aspect may further comprise cutting or dicing arrays of droplet generating units from the plurality of droplet generating units formed from bonding the nozzle plate and cap layer.

Some implementations of the present disclosure will now be described in detail with reference to the accompanying drawings in which.

Figure 1:
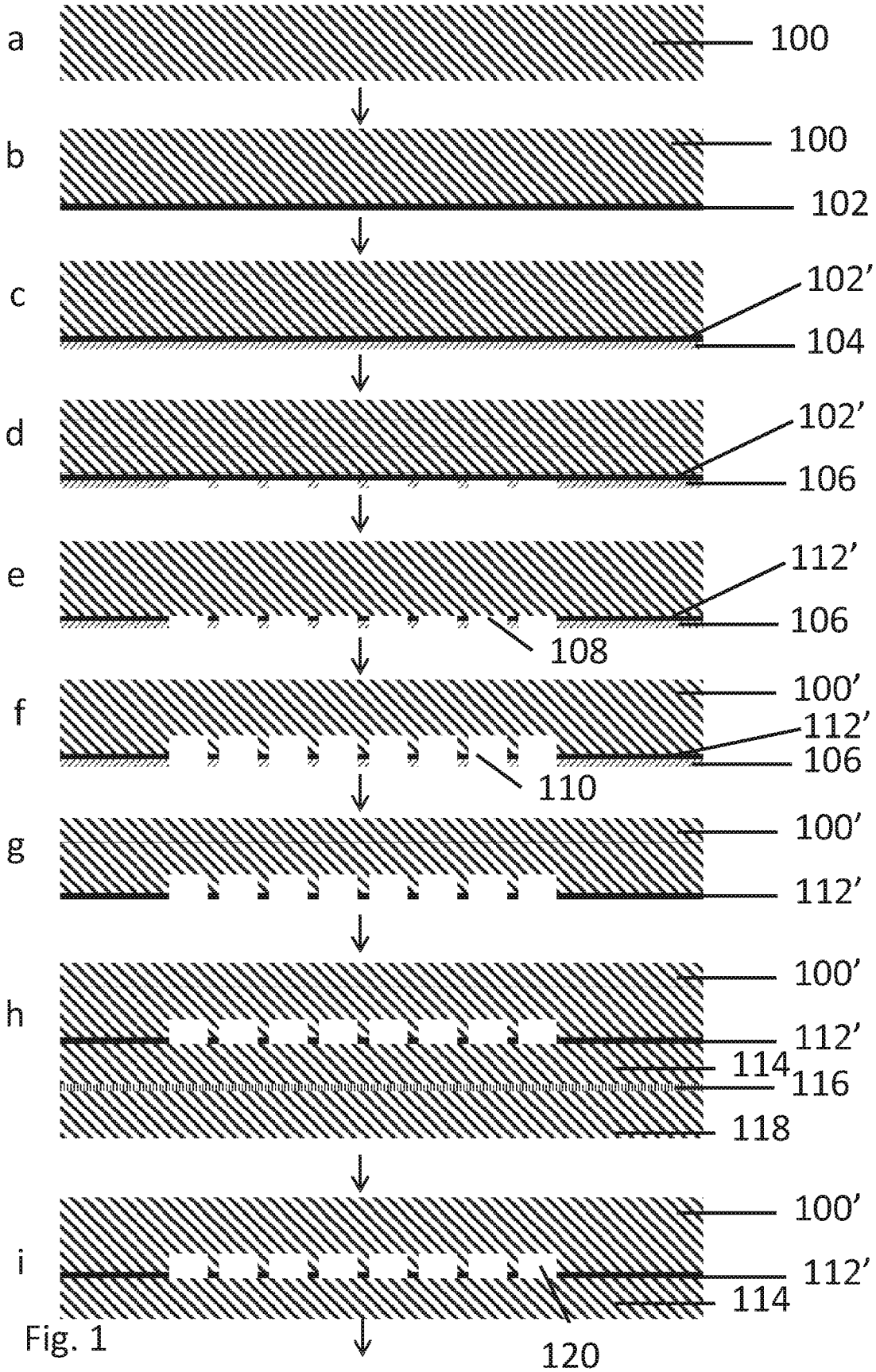
FIG. 1 is a flow chart generally illustrating the manufacture of a MEMS device comprising components which together define chambers according to one implementation (a) to (i) of the presently disclosed method.

Referring now to FIG. 1, the manufacture of a MEMS device according to one implementation of the presently disclosed method is generally illustrated by reference to components comprising bare silicon wafers 100 and 114 (see (a) and (i)).

A bonding material layer 102' is formed on a surface of the silicon wafer 100 by spin coating a precursor from a solution of benzocyclobutene (BCB; Cyclotene 3000, a trade mark of Dow Chemical Company) and partially curing the precursor layer 102 to form the partially cured BCB layer 102' by heating the wafer (see (a) and (b) of FIG. 1) at a temperature of 210° C. for 40 minutes.

After cooling to room temperature, a positive resist layer 104 (see (c)) is formed on the partially cured BCB layer 102' by spin coating a positive photoresist and soft baking it for example at 90-120° C., to evaporate the solvent.

After cooling to room temperature, the positive resist layer 104 is photo-irradiated with UV light and the irradiated areas are developed with the appropriate solvent (for example TMAH, tetra methyl ammonium hydroxide) to leave a mask layer 106 defining apertures (see (d)) in the photoresist layer.

The partially cured BCB layer 102' is dry etched through the apertures in the mask 106 by exposure to an $O_2/CF_4$ plasma to form a patterned BCB layer 112' comprising apertures 108 corresponding to those in the mask 106 (see (e)).

The silicon wafer 100 is then dry etched through the mask 106 (and the patterned BCB layer 112') by a subsequent exposure to a DRIE plasma, to form a patterned silicon wafer 100' comprising recesses or cavities 110 corresponding to those of the patterned BCB layer 112' (see (f)).

The mask 106 is removed by exposure to a suitable solvent (e.g. acetone N396) to leave the patterned BCB layer 112' and the patterned silicon wafer 100' (see (g)).

Note that etching the partially cured BCB layer 102' and the silicon wafer 100 through the mask 106 means that the patterned BCB layer 112' is substantially coincident with the bonding surfaces on the patterned silicon wafer 100'.

A second silicon wafer 114, attached to a support 118 by a thermal release bonding layer 116, is contacted with the patterned BCB layer 112' while heating to a temperature of 130° C. The temperature is held at 130° C. for 5 minutes during which a bonding force of 12 kN is applied. After cooling to 55° C., the application of the force is stopped. The heating continues in a stand-alone oven to a temperature of 250° C. for 1 hour to ensure that BCB layer 112' is fully cured (95-100%) and the bonding surface of the second silicon wafer 114 is firmly adhered (see (h)).

In an embodiment of 130° C. for 5 minute heating the heating is carried out at a temperature below that necessary for thermal release of the support 118 from the second silicon wafer 114. In an alternative embodiment, the thermal release tape is removed and the substrates subsequently heated to 250° C. for 60 minutes.

Once the bonding surface of the second silicon wafer 114 is firmly adhered to the patterned BCB layer 112', the heating is continued to a temperature at which the thermal release of the thermal release bonding layer 116 becomes operative and the support 118 is removed from the second silicon wafer 114 (see (i)).

Note that the second silicon wafer 114 may be cleaned to remove residue from the thermal release bonding layer 116—especially when it is to be provided with coatings or subsequent layers.

Note further that the bonding of the second silicon wafer 114 to the first silicon wafer 100' leads to a multilayer silicon wafer of two components which together define a plurality of chambers 120 therein with substantially no protrusion of the patterned BCB layer 112' into the chambers 120.

In another implementation, the bonding material layer 102 may be formed on a surface of the silicon wafer 100 by spin coating a precursor from a solution of benzocyclobutene (BCB; Cyclotene 4000, a trade mark of Dow Chemical Company) and partially curing the precursor layer by photo-irradiating it with UV light and developing with an appropriate solvent, for example DS2100 development solvent available from Dow Chemical Company. In this implementation the subsequent steps are generally identical to those described in relation to FIG. 1.

Figure 2:
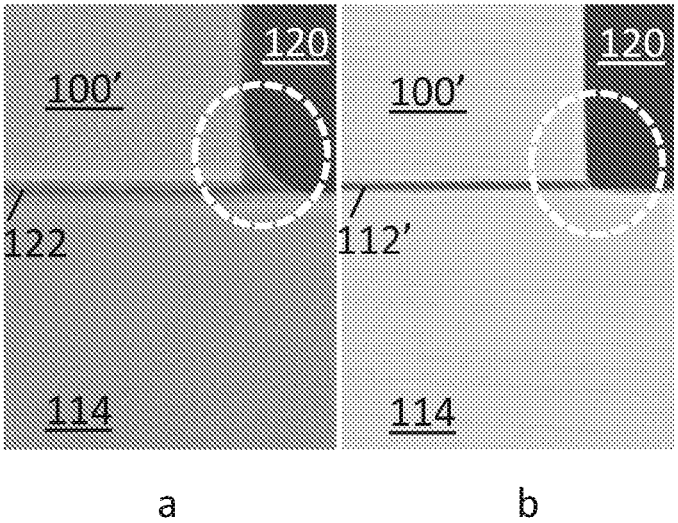
FIG. 2 shows scanning electron microscope (SEM) images of the extent of protrusion of the bonding material layer beyond the components into a chamber which are obtained by (a) an adhesive transfer bonding using a conventional epoxy-based adhesive as compared to (b) the implementation of FIG. 1.

FIG. 2 shows SEM images revealing the extent of protrusion of the BCB layer 112' as compared to an adhesive transfer bonding using a conventional epoxy-based adhesive. As may be seen, the extent of protrusion of the conventional epoxy-based adhesive 122 is substantial (see FIG. 2 (*a*)) whereas the extent of protrusion of the BCB layer 112' (see FIG. 2 (*b*)) is almost negligible at similar heating temperature and pressure.

The method may comprise etching the silicon wafer 100 through the mask 106 in areas of overlap with one or more channels provided in the silicon wafer 100. In that case, the etching may provide channels providing for the supply and exit of a fluid to a fluidic chamber, such as a pressure chamber, formed between the first and second components.

Thus, the method provides for the manufacture of a droplet generating unit for a droplet deposition head, such as an inkjet printhead.

Figure 3:
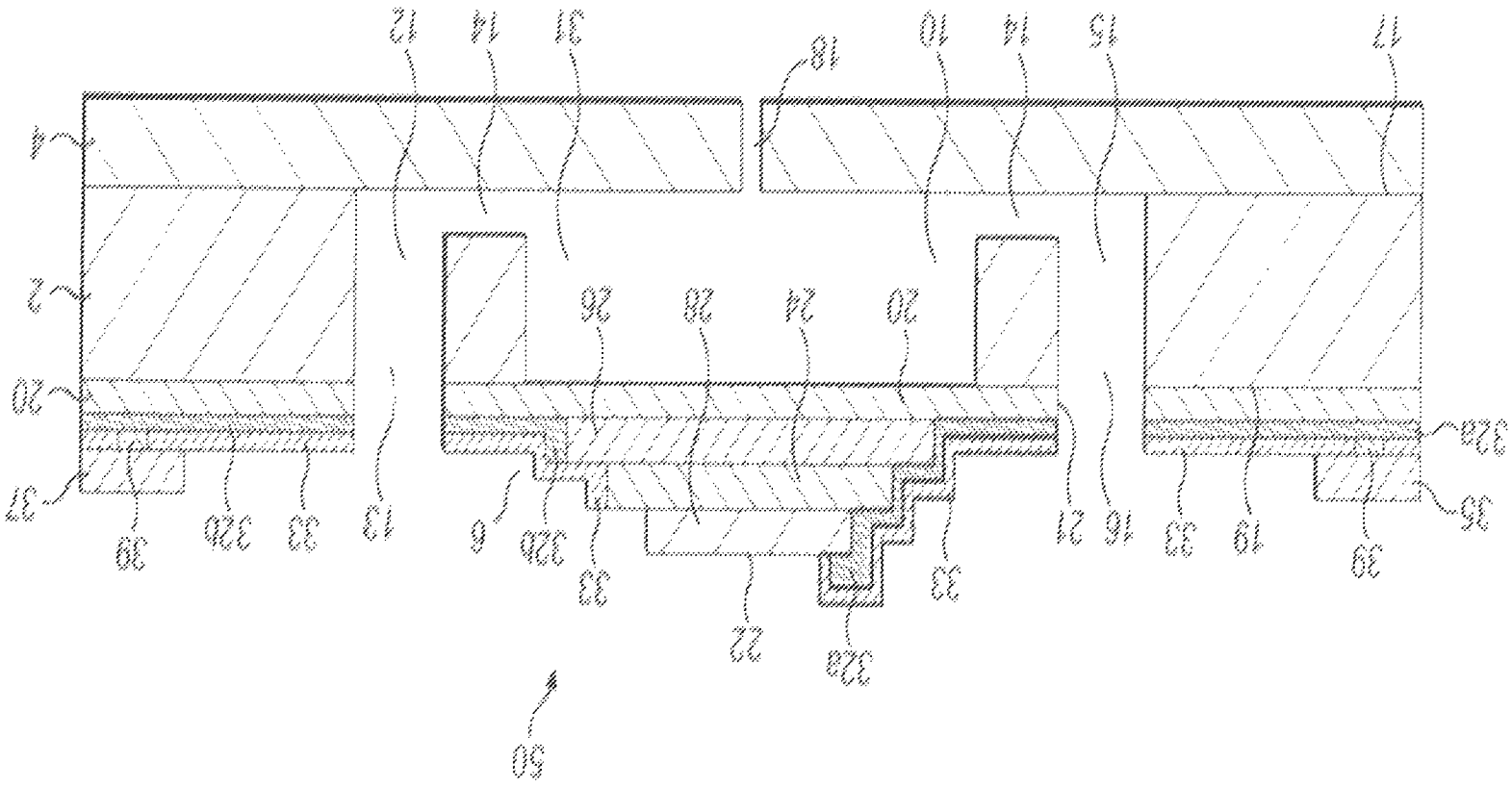
FIG. 3 is a cross-section view of a droplet generating unit for an inkjet printhead which may be manufactured according to one implementation the presently disclosed method.

Referring now to FIG. 3, a droplet generating unit 6 for an inkjet printhead 50 is formed by a fluidic chamber substrate 2 and a nozzle plate 4 provided on a bottom surface 17 thereof. The fluidic chamber substrate 2 and the nozzle plate 4 together define a pressure chamber 10 in fluidic communication with a fluidic supply channel 12 and a fluidic inlet port 13. The fluidic inlet port 13 is provided in a top surface of the fluidic chamber substrate 2 towards one end of the pressure chamber 10 along a length thereof.

The droplet generating unit 6 further comprises a fluidic channel 14 in fluidic communication with the fluidic supply channel 12 and pressure chamber 10 which is arranged to provide a path for fluid to flow therebetween. The droplet generating unit 6 also comprises a fluidic outlet port 16 in fluidic communication with the fluidic chamber 10 whereby fluid may flow from the pressure chamber 10 to the fluidic outlet port 16, via a fluidic channel 14 and fluidic return channel 15, provided in a top surface of the fluid chamber substrate 2 towards an end of the pressure chamber 10 opposite the end towards which the fluidic inlet port 13 is provided.

The fluidic chamber substrate 2 may comprise silicon, and in particular, a silicon wafer. The nozzle plate 4 can comprise silicon but it may also comprise any suitable material, such as a metal (e.g. electroplated nickel), an alloy (e.g. stainless steel), a glass (e.g. silicon dioxide), or a resin or polymer material (e.g. polyimide or SU8).

The droplet generating unit 6 further comprises a nozzle 18 in fluidic communication with the pressure chamber 10, whereby the nozzle 18 is formed in the nozzle plate 4 using any suitable process (e.g. chemical etching, DRIE or laser ablation). The nozzle 18 comprises a nozzle inlet and a nozzle outlet and may take any suitable form and shape.

The droplet generating unit 6 further comprises a membrane 20 provided on a top surface 19 of the fluidic chamber substrate and arranged to cover the pressure chamber 10. The membrane 20 is deformable to generate pressure fluctuations in the fluidic chamber 10 so as to change the volume within the pressure chamber 10 such that fluid may be ejected from the pressure chamber 10 via the nozzle 18 as a droplet.

The membrane 20 may comprise any suitable material such as a metal, an alloy, a dielectric material and/or a semiconductor material. Suitable materials include silicon nitride, silicon oxide, aluminium oxide, titanium oxide, zirconium oxide, tantalum oxide, silicon, silicon carbide or the like. The membrane 20 may comprise multiple layers of such materials. It may be formed using any suitable technique such as atomic layer deposition, sputtering, electrochemical processes and/or chemical vapour deposition. The apertures 21 corresponding to the fluidic ports 13, 16 may be provided in the membrane 20 using a patterning/masking technique during the formation of the membrane.

The droplet generating unit 6 further comprises an actuator 22 as a source of electromechanical energy provided on the membrane 20 and arranged to deform the membrane 20. The actuator is shown as a piezoelectric element 24 comprising a piezoelectric thin film located between two electrodes. The lower electrode 26 contacts the membrane 20 and the upper electrode 28 contacts a wiring layer provided on the membrane 20.

A wiring layer comprises electrical connections which may comprise two or more electrical tracks 32*a*, 32*b* to connect the upper electrode 28 and/or the lower electrode 26 to a controller (not shown) providing an electrical signal to the actuator 22. The electrical track 32*a* and the top electrode 28 are in electrical communication with a first electrical connection 35 in the form of an electrical contact (e.g. a drive contact), whilst the electrical track 32*b* and the bottom electrode 26 are in electrical communication with a second electrical connection in the form of an electrical contact 37 (e.g. a ground contact). The electrical contacts 35, 37 are in turn in electrical communication with the controller. The wiring layer may comprise a passivation material 33 to protect the electrical tracks 32*a*, 32*b* from the environment and from contacting the fluid. In that case, the electrical tracks 32*a*, 32*b* are in electrical communication with the electrical contacts 35, 37 through respective electrical vias 39.

The droplet generating unit 6 and, in particular, the pressure chamber 10, the fluidic channel 14, the fluidic supply and return channels 12, 15 and the fluidic inlet and outlet ports 13, 16 may be formed according to the presently disclosed method. Where the method provides a plurality of droplet generating units 6 for the printhead 50, the droplet generating units 6 of the fluidic chamber substrate 2 comprise chamber walls 31 provided between adjacent droplet generating units 6 along the length direction thereof.

Figure 4:
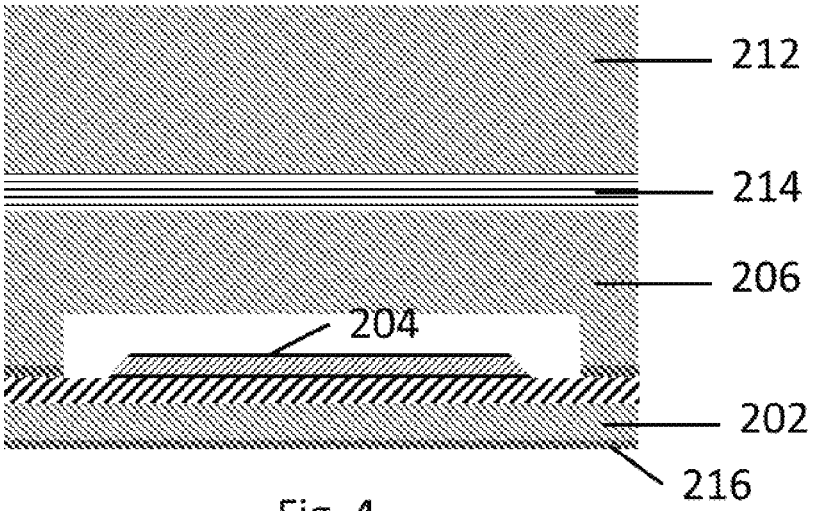
FIGS. 4 to 11 show the manufacture process steps of a droplet generating unit (shown in one cross-section view) for an inkjet printhead according to one implementation of the presently disclosed method.

Referring now to FIG. 4, a method for the manufacture of a droplet deposition head similar to that shown in FIG. 3 may start with a fluidic chamber substrate 202 comprising a silicon wafer upon which a piezoelectric actuator 204 is provided. The silicon wafer is bonded to a cap layer 206. The cap layer 206 is bonded to a support 212 by a thermal release bonding layer 214.

Figure 5:
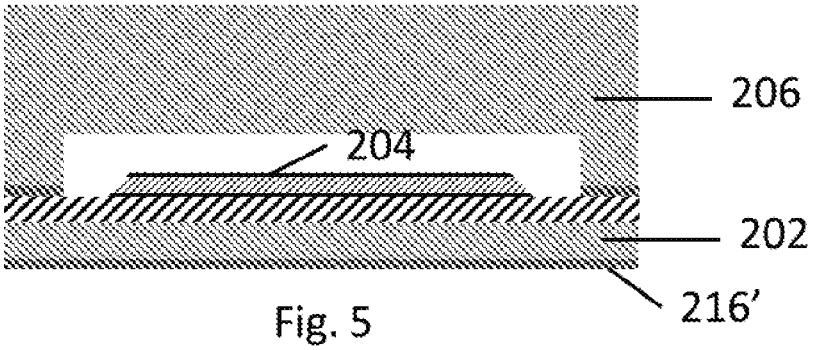

A bonding material precursor layer 216 of thickness about 1.0 μm to 2.2 μm is formed on a surface of the fluidic chamber substrate 202 by spin coating a solution of benzocyclobutene (BCB; Cyclotene 3022-35, a trade mark of Dow Chemical Company). After removing the support 212 (FIG. 5), the BCB layer is partially cured by heating the substrate 202 to 210° C. for 40 minutes, thus forming the partially cured BCB layer 216'.

Note that a BCB adhesion promoter (for example, AP3000, Dow Chemical Company) is preferably used to prime the surface of the fluidic chamber substrate 202. The adhesion promoter may be applied by spin coating and spun dry in the conventional way.

Figure 6:
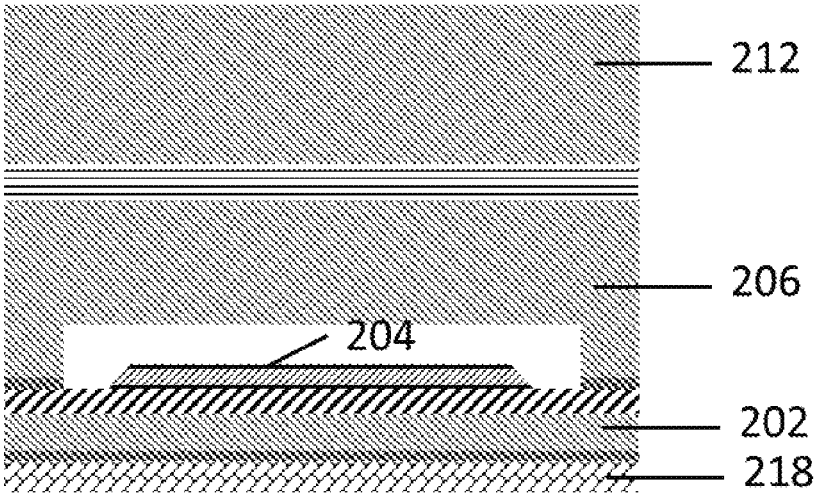

Referring now to FIG. 6, after cooling to room temperature and reattachment of the support 212, a positive resist layer 218 of thickness between 5 and 10 μm is formed on the partially cured BCB layer 216' by spin coating a positive photo resist from a solution and soft baking, for example at 90-120° C., to evaporate the solvent.

Figure 7:
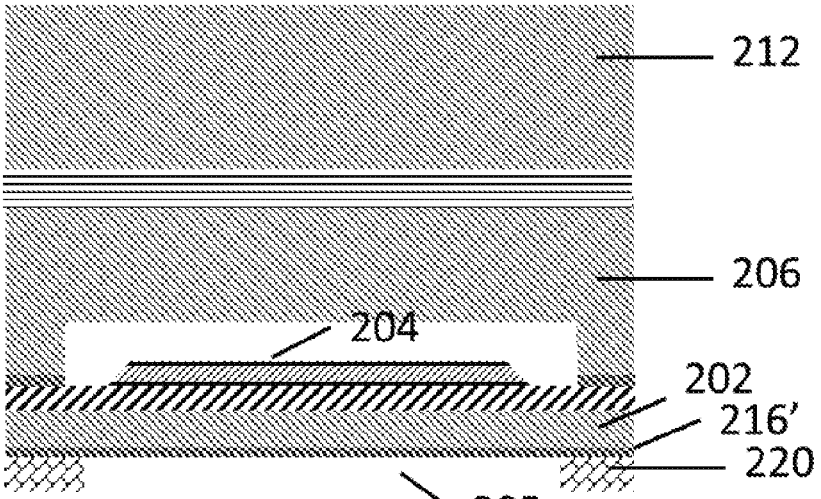

Referring now to FIG. 7, after cooling to room temperature, the positive resist layer 218 is photo-irradiated with UV laser light whereby the UV laser light is irradiated through a metal screen/mask so that the light is selectively directed to the areas of the photoresist that need to be irradiated and the irradiated areas are developed with an appropriate solvent, for example TMAH, tetra methyl ammonium hydroxide), to leave a mask 220 in the photoresist layer 218. The mask comprises apertures 205.

Figure 8:
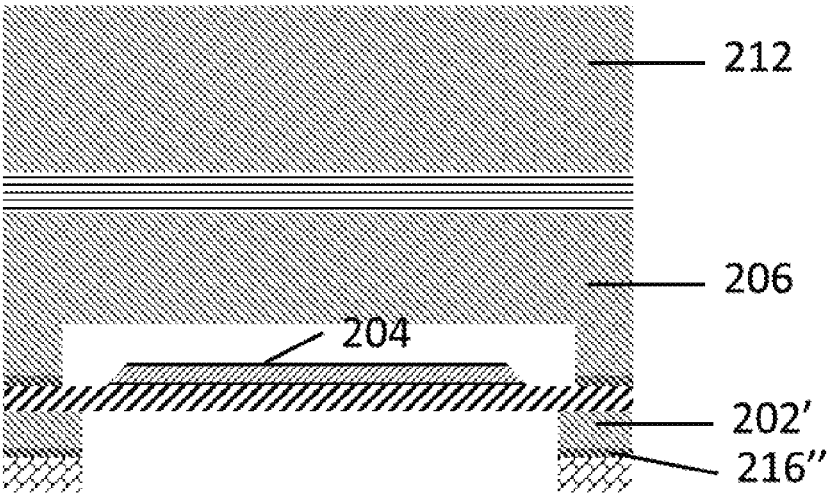

Referring now to FIG. 8, the partially cured BCB layer 216' and the fluidic chamber substrate 202 are etched through the mask 220 so that a portion of each of the bonding material layer 216' and the fluidic chamber substrate 202 are removed. The etching is performed in two steps first using a plasma (for example 4:1 $O_2$:$CF_4$ or 5:1 $O_2$:$SF_6$) to remove the portion of the partially cured BCB layer 216' and secondly using DRIE to remove the portion of the fluidic chamber substrate 202.

Figure 9:
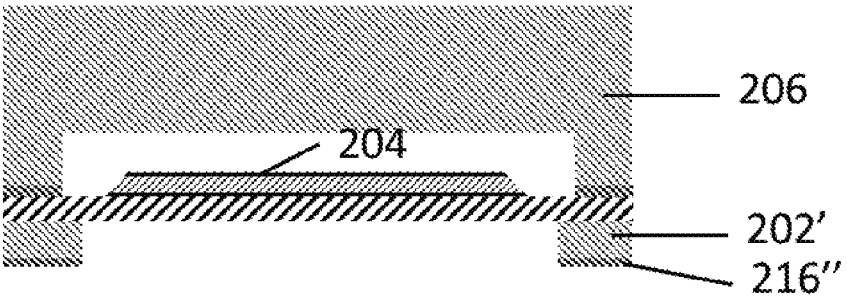

Referring now to FIG. 9, after removal of the support 212, the mask 220 is removed by a wet strip such as exposure to acetone for 30 minutes to leave a patterned BCB layer 216" and fluidic chamber substrate 202'.

Note that etching the BCB layer 216 and the fluidic chamber substrate 202 through the mask means that the patterned BCB layer 216" is substantially coincident with the bonding surfaces of the patterned fluidic chamber substrate 202'. In an alternative embodiment, etching of the BCB layer 216 and the fluidic chamber substrate 202 through the mask may be carried out as an anisotropic etch so the resultant chamber walls are tapered, comprise a trapezoidal cross-section or comprise a chamber wall surface that is not perpendicular to the bonding surfaces of the patterned fluidic chamber substrate 202'.

Figure 10:
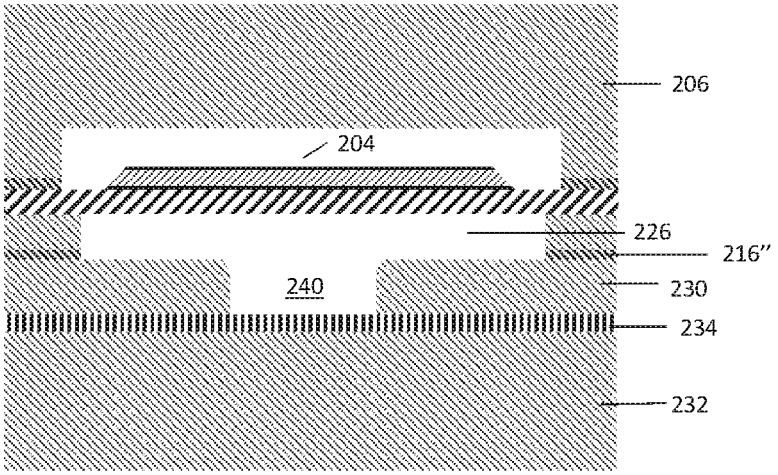

Referring now to FIG. 10, a nozzle plate 230, with a nozzle 240, attached to a support 232 by a thermal release bonding layer 234, is contacted with the patterned BCB layer 216" while heating and applying a bonding force. The temperature is held at 130° C. for 5 minutes during which a bonding force of 12 kN is applied. After cooling to 55° C., the application of the bonding force is stopped and the wafer is removed from the bonding chamber, the thermal tape and support handle is removed. Following this the heating is continued to a temperature of 250.0 for 1 hour to ensure that the patterned BCB layer 216" is fully cured (95-100%) and the nozzle plate 230 is firmly adhered.

Note that a BCB adhesion promoter (for example, AP3000 as described above) may also be used to prime the surface of the nozzle plate 230. Note further that the heating is carried out at a temperature below that necessary for thermal release of the support 232 from the nozzle plate 230.

Figure 11:
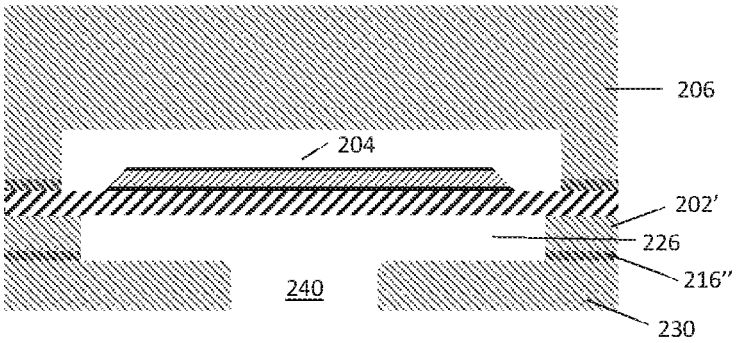

Referring now to FIG. 11, when the contacting surface of the nozzle plate 230 is firmly adhered to the patterned bonding material layer 216", the heating is continued at a temperature at which the thermal release bonding layer 234 becomes operative and the support 232 is removed from the nozzle plate 230.

The nozzle plate 230 and cap layer 206 are cleaned to remove residue from the thermal release bonding layers and a post bond cure is carried out to ensure that the BCB layer is fully cured and the bonding surface of the nozzle plate is firmly adhered to the patterned BCB layer.

The final thickness of the BCB layer 216" may be determined by scanning electron microscopy (SEM) and a target thickness of about 1 μm may be chosen.

The fluidic chamber substrate 202 and the nozzle plate 230 together define a fluidic chamber 226 similar to that shown in FIG. 3 (at 10).

Note, however, that the method may alternatively start with the bonding of the cap layer 206 to the fluidic chamber substrate 202 with a BCB layer and continue as described above.

In that case, the bonding of the cap layer is carried out in the same way as the bonding of nozzle plate 230 except without the patterning of the fluidic chamber substrate 202.

Figure 12:
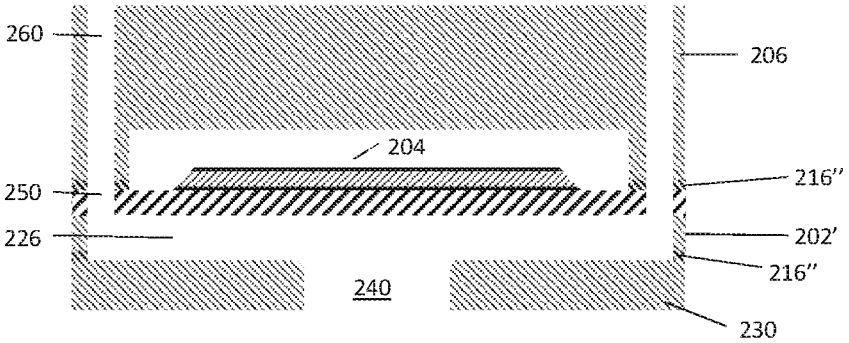
FIG. 12 is another cross-section view of the droplet generating unit for an inkjet printhead shown in FIG. 11.

FIG. 12 shows another cross section view of the droplet generating unit of FIG. 11. The cross section is perpendicular to the cross section shown in FIG. 11. The cap wafer 206 includes fluidic ports 260. The fluidic chamber wafer 202' includes fluidic ports 250 formed at the opposing ends of the fluidic chamber 226, preferably together with the fluidic chamber 226 in a single patterning step. A fluidic path is formed once the three wafers are bonded together and the fluidic ports 260 align with the fluidic ports 250.

The present disclosure provides a method for bonding the components which substantially avoids the protrusion of an adhesive into a fluidic chamber because it does not rely upon a conventional epoxy-based adhesive to bond components together.

Further, the method does not require that the components have similar size and shape or that they comprise such additional features as trenches or cavities or spacers in order to control adhesive protrusion.

Spin coating the bonding material precursor enables very precise control of the thickness of the bonding material layer on the surface of the first component. Such spin coating does not require additional tooling as compared to adhesive transfer bonding because the manufacturing process of MEMS devices typically comprises spin coating steps.

The etching of the bonding material layer and the silicon wafer through the mask means that the patterned bonding material layer is substantially coincident with the bonding surfaces on the patterned silicon wafer. This, together with the uniform application afforded by spin coating, results in a bonding material layer which is less likely to be forced into the chamber as compared to adhesive transfer process with conventional epoxy-based adhesives.

The use of a BCB bonding material layer is particularly advantageous because the partially cured BCB layer shows little or no flow under normal bonding pressures. Further, the fully cured BCB layer is thermally stable, chemically robust and compatible with a wide range of fluids (such as solvent based and aqueous based inks).

In addition, the curing process of the BCB which takes place through a polymerisation reaction does not lead to the formation of any significant amount of volatile by-products so that the final bonding material layer is substantially free from voids and has a bonding strength which is resistant to shear forces of 40 kg to 100 kg or higher and comparative to those obtained by adhesive transfer process with conventional epoxy-based resins.

The method may provide, therefore, an improved droplet generating device of higher reliability, capacity and lifetime as compared to a droplet generating device in which the nozzle plate is bonded by adhesive transfer process using conventional epoxy-based adhesives.

Note that the present disclosure necessarily refers in detail to a limited number of embodiments and that other embodiments which are not described here in detail are possible. For example, the bonding material layer may be formed from a partially cured bonding material not specifically mentioned in this disclosure but which is easily determined as suitable for patterning and bonding under normally applied pressures without significant deformation.

Note also that a reference to a particular range of values includes the starting and finishing values.

Note further that it is the accompanying claims which particularly point out an invention in the present disclosure and the scope of protection which is sought.

The invention claimed is:

1. A method for the manufacture of a microelectromechanical systems (MEMS) actuated fluidic device comprising bonded components arranged together to define at least one of a fluidic chamber and a fluidic path in the device, the method comprising:

forming a bonding material layer on a surface of a first component;

patterning the bonding material layer and the first component; and bonding a second component to the patterned bonding material layer and the first component, wherein:

the forming of the bonding material layer comprises providing a layer of curable material on the first surface of the first component and partially curing the layer of curable material by heating to a first temperature in an inert atmosphere, and the bonding of the second component to the patterned bonding material layer and the first component comprises fully curing the layer of curable material by heating the components to a second temperature higher than the first temperature.

2. A method according to claim 1, wherein the patterning of the bonding material layer and the first component comprises forming a mask layer defining a mask on the bonding material layer and removing a portion of the bonding material layer and a portion of the first component through the mask.

3. A method according to claim 1, wherein the patterning of the bonding material layer and the first component is performed in separate steps.

4. A method according to claim 1, wherein the patterning of the bonding material layer and the first component is performed by etching.

5. A method according to claim 4, wherein the etching is carried out as an anisotropic etching.

6. A method according to claim 5, wherein the anisotropic etching provides at least one wall surface of the at least one of a fluidic chamber and a fluidic path, the wall surface forming an angle different from 90° with the bonding surfaces of the bonding material layer.

7. A method according to claim 1, wherein the curable material comprises a polymerisable cyclic alkene.

8. A method according to claim 1, wherein:

the first component includes an actuator element arranged on a membrane so as to deform the membrane on receipt of an electronic control signal, the second component comprises a nozzle plate, and the first and second component together define a fluidic chamber and a fluidic path in the device.

9. A method according to claim 8, wherein the first component comprises part of a droplet generating unit, and wherein the device is a droplet deposition head.

10. A method according to claim 1, wherein:

the first component includes an actuator element arranged on a membrane so as to deform the membrane on receipt of an electronic control signal, the second component comprises a cap layer having a pre-formed cavity therein, and the first and second components together define a fluidic path in the device.

11. A method according to claim 1, further comprising:

forming a bonding material layer on another surface of the first component;

patterning the bonding material layer; and bonding a third component to the patterned bonding material layer and the first component, wherein:

the forming of the bonding material layer on the other surface of the first component comprises providing a layer of curable material on the other surface of the first component and partially curing the layer of curable material on that surface by heating to the first temperature in an inert atmosphere, and the bonding of the third component to the bonding material layer and the first component comprises fully curing the layer of curable material by heating the components to the second temperature.

12. A method according to claim 11, wherein:

the first component includes an actuator element arranged on a membrane so as to deform the membrane on receipt of an electronic control signal;

the second component comprises a nozzle plate and the third component comprises a cap layer having a pre-formed cavity; and the first and second components together define a fluidic chamber and a fluidic path in the device and the first and third components define a fluidic path in the device.

13. A method according to claim 1, further comprising:

forming a bonding material layer on a surface of a third component;

patterning the bonding material layer and the third component; and bonding the first component to the bonding material layer and the third component, wherein the forming of the bonding material layer on the surface of the third component comprises providing a layer of curable material on the surface of the third component and partially curing the layer of curable material by heating to the first temperature in an inert atmosphere, and the bonding of the third component to the patterned bonding material layer and the first component comprises fully curing the layer of curable material by heating the components to the second temperature higher than the first temperature.

14. A method according to claim 13, wherein:

the first component includes an actuator element arranged on a membrane so as to deform the membrane on receipt of an electronic control signal;

the second component comprises a nozzle plate and the third component comprises a cap layer having a pre-formed cavity; and the first and second components together define a fluidic chamber and a fluidic path in the device and the first and third components define a fluidic path in the device.

15. A method for the manufacture of a microelectromechanical systems (MEMS) actuated fluidic device comprising bonded components arranged together to define at least one of a fluidic chamber and a fluidic path in the device, the method comprising:

forming a bonding material layer on a surface of a first component;

patterning the bonding material layer; and bonding a second component to the patterned bonding material layer and the first component, wherein:

the forming of the bonding material layer comprises providing a layer of curable material on the first surface of the first component and partially curing the layer of curable material by heating to a first temperature in an inert atmosphere, and the bonding of the second component to the patterned bonding material layer and the first component comprises fully curing the layer of curable material by heating the components to a second temperature higher than the first temperature.

16. A method according to claim 15, wherein the curable material comprises a polymerisable cyclic alkene.

17. A method according to claim 15, wherein the first component includes an actuator element arranged on a membrane so as to deform the membrane on receipt of an electronic control signal, the second component comprises a cap layer having a pre-formed cavity therein and the first and second components together define a fluidic path in the device.

18. A method according to claim 17, wherein the first component comprises part of a droplet generating unit, and wherein the device is a droplet deposition head.

19. A method according to claim 15, further comprising:

forming a bonding material layer on another surface of the first component, patterning the bonding material layer and the first component and bonding a third component to the bonding material layer and the first component, wherein:

the forming of the bonding material layer on the other surface of the first component comprises providing a layer of curable material on the other surface of the first component and partially curing the layer of curable material by heating to the first temperature in an inert atmosphere, and the bonding of the third component to the bonding material layer and the first component comprises fully curing the layer of curable material by heating the components to the second temperature.

20. A method according to claim 19, wherein:

the first component includes an actuator element arranged on a membrane so as to deform the membrane on receipt of an electronic control signal, the second component comprises a cap layer having a pre-formed cavity and the third component comprises a nozzle plate, and the first and second components together define a fluidic path in the device and the first and third components define a fluidic chamber and a fluidic path in the device.

* * * * *